US006809248B2

(12) United States Patent
Torimura

(10) Patent No.: US 6,809,248 B2
(45) Date of Patent: Oct. 26, 2004

(54) ELECTRONIC MUSICAL APPARATUS HAVING MUSICAL TONE SIGNAL GENERATOR

(75) Inventor: Hiroyuki Torimura, Hamamatsu (JP)

(73) Assignee: Yamaha Corporation (JP)

( * ) Notice: Subject to any disclaimer, the term of this patent is extended or adjusted under 35 U.S.C. 154(b) by 0 days.

(21) Appl. No.: 10/341,106

(22) Filed: Jan. 13, 2003

(65) Prior Publication Data

US 2003/0131712 A1 Jul. 17, 2003

(30) Foreign Application Priority Data

Jan. 11, 2002 (JP) ..... 2002-004149

(51) Int. Cl.[7] ..... G10H 1/18; G10H 7/00
(52) U.S. Cl. ..... 84/615; 84/622; 84/477 R
(58) Field of Search ..... 84/477 R, 615, 84/622, 659, 653

(56) References Cited

U.S. PATENT DOCUMENTS 5,420,374 A * 5/1995 Hotta ..... 84/622
5,554,814 A * 9/1996 Nakata ..... 84/659
5,898,118 A * 4/1999 Tamura ..... 84/602
6,600,098 B2 * 7/2003 Mizuno et al. ..... 84/622

FOREIGN PATENT DOCUMENTS

JP 8-87270 4/1996

* cited by examiner

*Primary Examiner*—Jeffrey W Donels
(74) *Attorney, Agent, or Firm*—Rossi & Associates

(57) ABSTRACT

A CPU 31 reads out musical tone control information such as tone color data and effect data from an external storage device 35 or retrieves it via an interface circuit 51. The CPU 31 supplies the musical tone control information to a tone generator 41 and an effect circuit 42 in order to control the tone color of a musical tone signal and the effect added to the signal, using the musical tone control information. When the musical tone control information is not applicable to the tone generator 41 and the effect circuit 42, the information is substituted by musical tone control information applicable to the tone generator 41 and effect circuit 42 and stored in a ROM 33 for the use later on. On a display unit 13 there is displayed the name of substituted tone color data or effect data with information that a substitution has been made. The above facilitates the convenience of the use of musical tone control information such as tone color and effect stored outside when an electronic musical apparatus retrieves the information.

21 Claims, 9 Drawing Sheets

FIG. 4

| category name | tone color name (low-grade model) | | tone color name (high-grade model) | |
|---|---|---|---|---|
| piano (1-5) | 1<br>3 | grand piano<br>electric piano | 1 | grand piano |
| | | | 2 | bright piano |
| | | | 3 | electric piano |
| | | | 4 | harpsichord |
| | | | 5 | clavinova |
| chromatic percussion (6-10) | 6<br>9 | celesta<br>marimba | 6 | celesta |
| | | | 7 | glockenspiel |
| | | | 8 | music box |
| | | | 9 | marimba |
| | | | 10 | xylophone |
| organ (11-15) | 11<br>13 | draw organ<br>reed organ | 11 | draw organ |
| | | | 12 | church organ |
| | | | 13 | reed organ |
| | | | 14 | accordion |
| | | | 15 | harmonica |
| | | | | |

FIG. 5

| category name | effect name (low-grade model) | | effect name (high-grade model) | |
|---|---|---|---|---|
| reverberation (1-5) | 1<br>5 | hall<br>stage | 1 | hall1 |
| | | | 2 | hall2 |
| | | | 3 | room1 |
| | | | 4 | room2 |
| | | | 5 | stage |
| chorus (6-10) | 6<br>8 | chorus1<br>celesta1 | 6 | chorus1 |
| | | | 7 | chorus2 |
| | | | 8 | celesta1 |
| | | | 9 | celesta2 |
| | | | 10 | flanger |
| | | | | |

FIG. 6

| registration1 | registration2 | registration3 | registration4 | ··· |
|---|---|---|---|---|
| tempo1<br>loudness1 (0-127)<br>tone color1 (number)<br>effect1 (number)<br>style1 (number) | tempo2<br>loudness2<br>tone color2<br>effect2<br>style2 | tempo3<br>loudness3<br>tone color3<br>effect3<br>style3 | tempo4<br>loudness4<br>tone color4<br>effect4<br>style4 | ··· |
| tone color parameters for tone color 1<br>· original tone color number<br>· attack rate<br>· decay rate<br>· release rate | tone color parameters for tone color 2 | tone color parameters for tone color3 | tone color parameters for tone color 4 | ··· |
| effect parameters for effect 1<br>· original effect number<br>· depth of modulation<br>· modulation rate | effect parameters for effect 2 | effect parameters for effect 3 | effect parameters for effect 4 | ··· |

grand piano
grand piano**
electric piano
marimba
celesta**
grand piano****** output tone color
grand piano****

ELECTRONIC MUSICAL APPARATUS HAVING MUSICAL TONE SIGNAL GENERATOR

BACKGROUND OF THE INVENTION

1. Field of the Invention

The present invention relates to an electronic musical apparatus which retrieves, from outside, musical tone control information for controlling the generating conditions of a musical tone signal such as tone color, effect and style (type of automatic accompaniment pattern) of a musical tone signal, and controls the generating conditions of musical tone signals in accordance with the retrieved musical tone control information.

2. Description of the Related Art

Conventional electronic musical apparatuses of this type, which have an internal storage device for previously storing plural types of musical tone control information and a retrieval device for retrieving musical tone control information stored in an external storage device, are designed to selectively supply to a musical tone signal generator the musical tone control information stored in the internal storage device and external storage device, and to variously control the generating conditions of a musical tone signal. Usually, however, a musical tone signal generator of a high-grade electronic musical apparatus is prepared for a wide variety of musical tone control information, while that of a low-grade electronic musical apparatus is not prepared for a wide variety of musical tone control information but for only limited types of musical tone control information. As a result, when a low-grade electronic musical apparatus retrieves musical tone control information previously stored in a high-grade electronic musical apparatus or musical tone control information which has been generated in a high-grade electronic musical apparatus and stored in an external storage device in order to control the generating conditions of musical tone signals, there may be cases where some musical tone signals are not generated, or unexpected, odd musical tone signals are generated.

In order to prevent such cases, as described in Japanese Non-examined Patent Publication No. 8-87270, an electronic musical apparatus has been invented which stores, in a classified manner, plural types of musical tone control information applicable to the musical tone signal generator of the apparatus. When musical tone control information which is not applicable to the electronic musical apparatus is required, the apparatus selects one type of musical tone control information belonging to the same category from among the plural types of musical tone control information stored in the internal storage device, supplies it to the musical tone signal generator, and controls the generating conditions of musical tone signals in accordance with the musical tone control information supplied. Such automatic substitution of musical tone control information prevents musical tone signals from failing to be generated and odd musical tone signals from being generated.

However, the above conventional apparatus described in Japanese Non-examined Patent Publication No. 8-87270 still poses an inconvenience that a user of the apparatus cannot realize automatic substitution of musical tone control information until musical tone signals whose generating conditions have been controlled in accordance with substituted musical tone control information are generated. The conventional apparatus also causes another inconvenience that when substituted musical tone control information is quite similar to the original musical tone control information, it is difficult for the user to tell whether the generated musical tone signal is based on musical tone control information supplied from outside or substituted musical tone control information. In such a case, even though the substitution of musical tone control information has brought about subtle change in the generated musical tone signal, the user may not be able to tell whether the subtle change is caused by the substitution of the musical tone control information.

SUMMARY OF THE INVENTION

The present invention was accomplished to solve the above-described problems, and an object thereof is to provide an electronic musical apparatus which allows a user to know whether musical tone control information has been substituted, a method applicable to the apparatus, and a computer-readable program applicable to the apparatus.

In order to achieve the above-described object, a feature of the present invention lies in an electronic musical apparatus having a musical tone signal generator for generating a musical tone signal whose generating conditions are controlled in accordance with input musical tone control information, an internal storage device for storing plural types of musical tone control information for which the musical tone signal generator is prepared, and a display unit for displaying a name of musical tone control information stored outside for selective use by a user, the electronic musical apparatus comprising a display controller for automatically selecting, in accordance with predetermined conditions, one type of musical tone control information as substituted musical tone control information from among plural types of musical tone control information stored in the internal storage device when musical tone control information which is stored outside and for which the musical tone signal generator is not prepared is intended to be input on the occasion of input of musical tone control information stored outside, and displaying on the display unit a name of the substitute musical tone control information in a manner which allows a user to recognize that the displayed musical tone control information is substituted, an information selector for selecting musical tone control information corresponding to the name displayed on the display unit, and an information provider for retrieving musical tone control information selected by the information selector from outside and providing the retrieved musical tone control information to the musical tone signal generator when the selected musical tone control information is not the substitute musical tone control information, and for providing the substitute musical tone control information stored in the internal storage device to the musical tone signal generator when musical tone control information selected by the information selector is the substitute musical tone control information.

For example, in this case, the apparatus may be configured such that the internal storage device stores plural types of musical tone control information under plural categories and the display controller includes a first selector for automatically selecting as substituted musical tone control information, from among plural types of musical tone control information stored in the internal storage device, musical tone control information belonging to an identical category when among the musical tone control information stored outside, musical tone control information for which the musical tone signal generator is not prepared is intended to be input.

Also, the display controller may be configured to further include a second selector for automatically selecting as substituted musical tone control information, from among plural types of musical tone control information stored in the internal storage device, a predetermined type of musical tone control information when among the musical tone control information stored outside, musical tone control information for which the musical tone signal generator is not prepared is intended to be input and the internal storage device does not store any musical tone control information belonging to an identical category with the intended musical tone control information.

In the invention configured as described above, furthermore, musical tone control information may be configured by controlling parameters for controlling generating conditions of a musical tone signal and identifying information (a name in some cases) representing the type of the controlling parameters (musical tone control information). The above-described selection of musical tone control information to be substituted may be made by comparing the identifying information of musical tone control information stored outside with that of musical tone control information stored in the internal storage device. The identifying information may be also used for the display of a name of musical tone control information.

According to the feature, when the user retrieves musical tone control information stored outside, particularly, musical tone control information for which the musical tone signal generator is not prepared targeted for retrieval, selected as substituted musical tone control information is musical tone control information stored in the internal storage device and applicable to the musical tone signal generator. On the display unit, the name of the substituted musical tone control information is displayed in a manner which allows the user to recognize that the information has been substituted. Therefore, when the user tries to retrieve musical tone control information stored outside into the electronic musical apparatus, the user is allowed to easily distinguish between musical tone control information for which the musical tone signal generator is prepared and that for which the musical tone signal generator is not prepared, with the convenience of the use of the musical tone control information stored outside facilitated.

Another feature of the present invention lies in an electronic musical apparatus having a musical tone signal generator for generating a musical tone signal whose generating conditions are controlled in accordance with input musical tone control information, an internal storage device for storing plural types of musical tone control information for which the musical tone signal generator is prepared, and a display unit, the electronic musical apparatus comprising an information retriever for retrieving musical tone control information from outside and a substitute controller for automatically selecting, in accordance with predetermined conditions, one type of musical tone control information as substituted musical tone control information from among plural types of musical tone control information stored in the internal storage device when the musical tone control information retrieved from outside is not applicable to the musical tone signal generator, providing the substituted information to the musical tone signal generator, and displaying on the display unit a name of the substitute musical tone control information in a manner which allows a user to recognize that the displayed musical tone control information is substituted.

For example, in this case, the apparatus may be configured such that the internal storage device stores plural types of musical tone control information under plural categories and the substitute controller includes a first selector for automatically selecting, as substituted musical tone control information, musical tone control information belonging to an identical category with the musical tone control information retrieved from outside from among plural types of musical tone control information stored in the internal storage device and providing the substituted information to the musical tone signal generator, and a first display controller for displaying, on the display unit, a name of the substituted musical tone control information selected by the first selector in a first identification manner which allows a user to identify the name as substitute.

The substitute controller may be configured to further include a second selector for automatically selecting, as substituted musical tone control information, a predetermined type of musical tone control information from among plural types of musical tone control information stored in the internal storage device when the musical tone control information retrieved from outside is not applicable to the musical tone signal generator and does not belong to any categories of plural types of musical tone control information stored in the internal storage device, and providing the substituted information to the musical tone signal generator and a second display controller for displaying, on the display unit, a name of the substituted musical tone control information selected by the second selector in a second identification manner which allows a user to identify the displayed name as substitute and which is different from the first identification manner.

In this case as well, musical tone control information may be configured by controlling parameters for controlling generating conditions of a musical tone signal and identifying information (a name in some cases) representing the type of the controlling parameters (musical tone control information). The selection of musical tone control information to be substituted may be made by comparing the identifying information of musical tone control information stored outside with that of musical tone control information stored in the internal storage device. The identifying information may be also used for the display of a name of musical tone control information.

According to the feature, on the display unit there is displayed that a substitution has been made when musical tone control information for which the musical tone signal generator is not prepared is retrieved from outside by the information retriever, and the retrieved musical tone control information is substituted by musical tone control information for which the musical tone signal generator is prepared by the function of the substitute controller. Therefore, when the user tries to retrieve musical tone control information stored outside into the electronic musical apparatus, the user is allowed to easily know whether musical tone control information has been substituted, with the convenience of the use of musical tone control information outside facilitated.

Furthermore, another feature of the present invention also lies in a method and a computer readable program which are applied to an electronic musical apparatus having a musical tone signal generator, an internal storage device and a display unit similar to the above and implement functions as described above.

BRIEF DESCRIPTION OF THE DRAWINGS

FIG. 4 is a data format diagram showing a tone color table stored in a tone color data storage area of the ROM shown in FIG. 1;

FIG. 5 is a data format diagram showing an effect table stored in an effect data storage area of the ROM shown in FIG. 1;

FIG. 6 is a data format diagram showing example registration data used by the electronic musical instrument shown in FIG. 1;

DESCRIPTION OF THE PREFERRED EMBODIMENT

Figure 1:
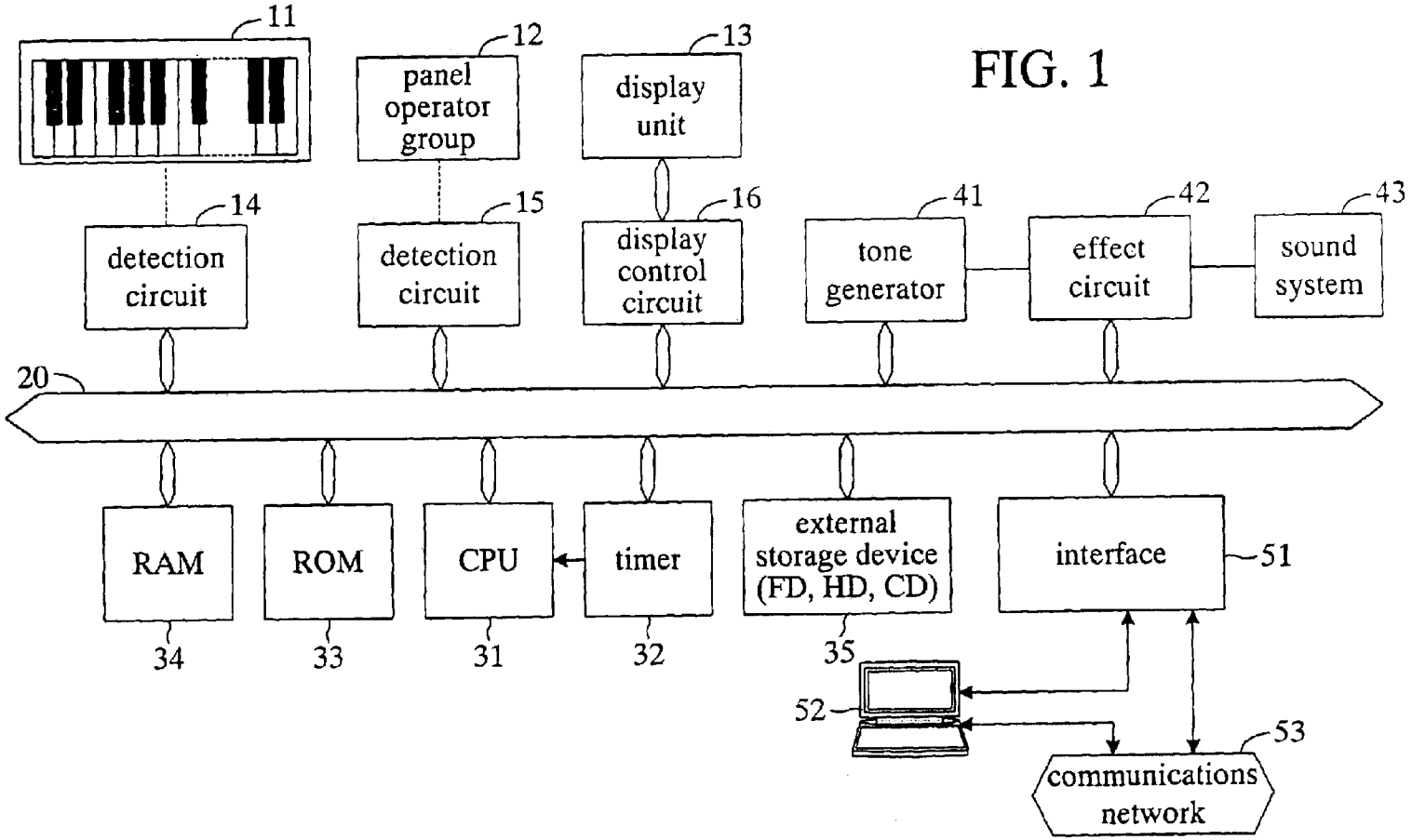
FIG. 1 is a schematic block diagram showing an electronic musical instrument according to an embodiment of the electronic musical apparatus in the present invention.

An embodiment of the present invention will now be described with reference to the drawings. FIG. 1 is a block diagram showing an electronic musical instrument according to an electronic musical apparatus of the present invention.

The electronic musical instrument includes a keyboard 11, a panel operator group 12, and a display unit 13. The keyboard 11 has plural keys used as performance operators. The depression and release of each key cause generation and halt of a tone signal. The depression and release of a key are detected by ON/OFF operation of a key switch, respectively. The key switches provided in corresponding relation to each key are disposed in a detection circuit 14 which is connected to a bus 20.

The panel operator group 12, which is disposed on the front panel of the electronic musical instrument, is operated in order to trigger various operations of the electronic musical instrument. In the present embodiment, particularly, the panel operator group 12 is operated in order to make a selection of musical tone control information such as tone color information, effect control information or selection information of style (type of automatic accompaniment) and to trigger automatic performance. The operations of the panel operator group 12 are detected by ON/OFF operations of operator switches. The operator switches provided in corresponding relation to each operator are disposed in a detection circuit 15 which is connected to the bus 20. A display unit 13, which is configured by a liquid crystal display or a cathode ray tube device, etc., displays characters, notes, graphics, and so on. The display conditions of the display unit 13 are controlled by a display control circuit 16 which is connected to the bus 20.

Connected to the bus 20 are a CPU 31, a timer 32, a ROM 33, a RAM 34, an external storage device 35, a tone generator 41, and an effect circuit 42. The CPU 31, the timer 32, the ROM 33, and the RAM 34, which configure the main unit of a microcomputer, control various operations of the electronic musical instrument by executing programs.

Figure 2:
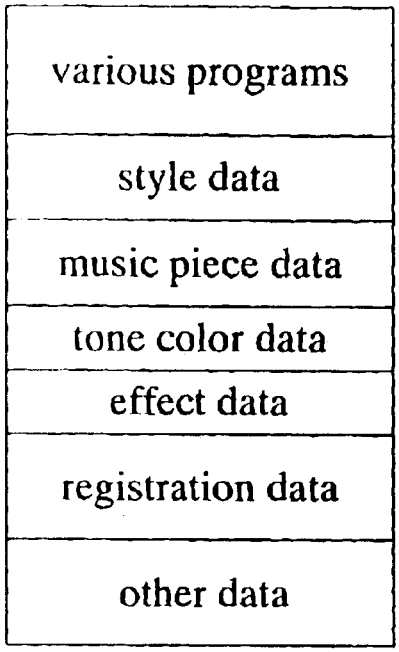
FIG. 2 is a map showing various storage areas of a ROM shown in FIG. 1.

In the ROM 33, as shown in FIG. 2, there are disposed various storage areas. In a program storage area there are stored a system program and some of the programs for implementing various functions of the present electronic musical instrument. In a style data storage area there is stored a series of accompaniment control data for controlling generation of accompaniment tones, the data being provided for each type of automatic accompaniments such as march or waltz which are applicable to the present electronic musical instrument.

In a music piece data storage area there is stored automatic performance data for demonstration. The automatic performance data, as exemplified in FIG. 3, comprises initial data, plural pieces of performance event data, plural pieces of duration data, and end data. The initial data, as in the case of registration data which will be explained later, comprises plural kinds of control data for controlling various generating conditions of a tone signal such as tone color, effect and style (type of automatic accompaniment pattern) of a tone signal. The performance event data represents a performance event of a musical instrument in accordance with progression of a music piece, specifying key-depression, key-release, tone color, effect and so on. The performance event data specifying key-depression comprises key-on data representing the depression of a key, note number data representing the depressed key (pitch), and velocity data representing the speed of the key-depression (loudness). The performance event data specifying key-release comprises key-off data representing the release of a key and note number data representing the released key (pitch).

The performance event data specifying tone color, which comprises tone color number data (including tone color parameters in some cases), is used for changing a tone color during automatic performance. The performance event data specifying effect, which comprises effect number data (including effect parameters in some cases), is used for changing an effect during automatic performance. Duration data represents the time elapsed between each performance event. End data represents the end of a music piece.

In a tone color data storage area there is stored a tone color table which stores the names of tone colors for which the present electronic musical instrument is prepared, with the tone color names categorized. The tone color data storage area also stores tone color parameter groups provided for each tone color in order to generate a tone signal of each tone color in the tone generator 41. The tone color table will now be described in detail with reference to FIG. 4. FIG. 4 shows both the tone color table of low-grade models and that of high-grade models. The high-grade models have more tone colors than the low-grade models. The tone color table of the high-grade models has more tone color names and tone color numbers than that of the low-grade models does. Tone color names of both models are categorized separately because high-grade models are prepared for more kinds of tone colors than low-grade models.

In the tone color table of the low-grade models, for example, there are stored tone color names such as grand piano, electric piano, celesta, marimba, draw organ or reed organ, and tone color numbers (1, 3, 6, 9, 11, 13, etc.) corresponding to the tone color names. In the tone color table, there are also stored category names to which aforementioned tone color names belong such as piano, chromatic percussion or organ, and the range of tone color numbers which each category contains (1 to 5, 6 to 10, 11 to 15). When compared to the tone color table of the low-grade models, the tone color table of the high-grade models stores more tone color names and tone color numbers. As the tone color names (and tone color numbers) belonging to the category of piano, for example, there are stored a grand piano (1), bright piano (2), electric piano (3), harpsichord (4) and clavinova (5). Tone color names belonging to one category represent tone colors generated by musical instruments that are similar each other, that is, they represent tone colors of similar musical tones. Although the category names provided for the low-grade models are about the same as those for the high-grade models, there may be cases where the high-grade models have more category names than the low-grade models.

In an effect data storage area there is stored an effect table which stores the names of effects applicable to the present electronicmusical instrument, with the effect names categorized. The effect data storage area also stores effect parameter groups provided for each effect to be added to a tone signal in the effect circuit 42. The effect table, which is shown in FIG. 5 using a similar diagram to FIG. 4, stores effect names, effect numbers, category names to which effect names belong, and the range of the effect numbers that each category name contains. Regarding the effect table as well, the kinds of available effects varies among models: low-grade models have fewer kinds of effects available for adding to tone signals, compared to high-grade models. In this case as well, this is because high-grade models are prepared for more kinds of effects than low-grade models.

In a registration data storage area there are stored plural sets of registration data. A set of registration data comprises plural kinds of control data for controlling various generating conditions of a tone signal. The generating conditions include tone color, effect and style (type of automatic accompaniment pattern) of a tone signal. By specifying a set of registration data, a certain state of a musical tone that is to be set by various operations of the panel operator group 12 can be brought about. As shown in FIG. 6, for example, a set of registration data comprises tempo data representative of the tempo of automatic accompaniment, loudness data representative of the loudness of a musical tone to be generated, tone color number data representative of the kind of the tone color of a musical tone to be generated, effect number data representative of the kind of an effect added to a tone to be generated, style number data representative of the style of automatic accompaniment (type of automatic accompaniment pattern), various tone color parameters for controlling the tone color represented by the tone color number data, various effect parameters for controlling the effect represented by the effect number data, etc. These tone color parameters and effect parameters are for supplementing or revising the tone color parameters and effect parameters stored in the ROM 33.

The external storage device 35, which includes a hard disk HD previously embedded in the present electronic musical instrument, various storage media applicable to the electronic musical instrument such as compact disk CD and flexible disk FD, and drive units for each storage medium, is capable of storing and reading voluminous data and programs. In the storage media, there are stored various kinds of programs, style data, music piece data, tone color data, effect data, registration data and other data. These programs and data are the same kinds as those stored in the ROM 33, but different from them. Particularly, the present embodiment is characterized in, among others, that the present electronic musical instrument can support storage media such as compact disk CD and flexible disk FD which store the above-mentioned various data that has been written on the other electronic musical apparatus including an electronic musical instrument.

The tone generator 41 forms musical tone signals in accordance with performance information (key-on signal, key-off signal, note number, velocity, etc.) sent from the CPU 31. Under the control by the CPU 31, musical tone elements including tone colors of tone signals to be formed by the tone generator 41 are controlled on the basis of tone element control parameters including tone color parameters supplied from the ROM 33 or the external storage device 35 (RAM 34 in some cases). In this case, generally, in addition to the tone color parameters stored in the ROM 33 in corresponding relation to the tone color table, the tone color parameters included in the registration data in the ROM 33 or the tone color parameters stored in the external storage device 35 are used as supplemented or added parameters. However, the performance capabilities of the tone generator 41 vary among models; each model has its own limit on available musical tone elements including tone colors.

The effect circuit 42 is for adding various musical effects such as reverberation or chorus to the tone signals generated by the tone generator 41. Under the control by the CPU 31, the effect circuit 42 is also controlled on the basis of various effect parameters supplied from the ROM 33 or the external storage device 35 (RAM 34 in some cases). In this case as well, generally, in addition to the effect parameters stored in the ROM 33 in corresponding relation to the effect table, the effect parameters included in the registration data in the ROM 33 or the effect parameters stored in the external storage device 35 are used as supplemented or added parameters. Also, the performance capabilities of the effect circuit 42 vary among models; each model has its own limit on the available effects.

The tone signals to which effects have been added at the effect circuit 42 are supplied to a sound system 43. The sound system 43, which has amplifiers, speakers, etc., generates musical tones corresponding to the supplied tone signals.

To the bus 20 an interface circuit 51 is also connected. The interface circuit 51 is for inputting various data such as automatic performance data or tone control data and various programs from an external electronic musical apparatus 52 such as other electronic musical instrument or personal computer. Besides, the interface circuit 51 is allowed to connect to outside via a communications network 53, enabling the electronic musical instrument to exchange various programs and data with the outside.

Next, the operations of the embodiment configured as described above will be explained. First, the general operations of the electronic musical instrument will be described. A user operates the panel operator group 12 in order to program various tone elements such as style (type of accompaniment tones) and tone color of tone signals formed by the tone generator 41 or effect added to the tone signals by the effect circuit 42. When programming these tone elements, the user may separately program each controlling condition of the tone elements such as tone color, style, or effect by operating the panel operator group 12. The user may also select, at one time, controlling conditions of plural tone elements such as tone color, style or effect by specifying registration data stored in the ROM 33, the external storage device 35, etc. by the operations of the panel operator group 12. Further, the user may input the controlling condition of each tone element separately or input plural tone elements simultaneously from outside via the external electronic musical apparatus 52 or the communications network 53.

In these cases, the tone color parameters on the above-programmed or above-selected tone color are supplied to the tone generator 41 from the ROM 33, external storage device 35, external electronic musical apparatus 52 or communications network 53. The control parameters on the above-programmed or above-selected style are temporarily stored in the RAM 34 and used for a program for generating accompaniment tone signals which is not shown. The effect parameters on the above-programmed or above-selected effect are supplied to the effect circuit 42 from the ROM 33, external storage device 35, external electronic musical apparatus 52 or communications network 53.

In this state, if the user operates the keyboard 11 in order to start a performance, the key-depression/release information caused by the performance operations is supplied to the tone generator 41. The tone generator 41 forms a tone signal in accordance with the key-depression/release information and outputs it to the effect circuit 42. Since the tone generator 41 uses the above-supplied tone color parameters in order to form the tone signal, the tone signal of the above-programmed or above-selected tone color is to be supplied to the effect circuit 42. Since the effect circuit 42 also uses the above-supplied effect parameters in order to add an effect to the tone signal, the above-programmed or above-selected effect is added to the tone signal. Then, a musical tone corresponding to the tone signal with the above-programmed or above-selected tone color and the above-programmed or above-selected effect is generated via the sound system 43.

On the other hand, by executing a program which is not shown, the CPU 31 forms data for controlling automatic accompaniment tones corresponding to the above-programmed or above-selected style, using the above key-depression/release information or without using the key-depression/release information (rhythm tone signals are unrelated to key-depression/release information). Then the CPU 31 outputs the data to the tone generator 41. The tone generator 41 then forms and outputs accompaniment tone signals corresponding to the supplied automatic accompaniment tone control data. In this case as well, the tone generator 41 controls the accompaniment tone signals so that they have the above-programmed or above-selected tone color, while the effect circuit 42 adds to the accompaniment tone signals the above-programmed or above-selected effect. Then, musical tones corresponding to the accompaniment tone signals having the above-programmed or above-selected tone color and above-programmed or above-selected effect are generated via the sound system 43.

The user may also replay the automatic performance data (see FIG. 3) stored in the ROM 33 or external storage device 35 by operating the panel operator group 12. In this case, the initial data for controlling generating conditions of tone signals is supplied to the tone generator 41 and the effect circuit 42 when the replay is started. Then, the tone generator 41 uses the supplied initial data in order to control the tone color, etc. of the tone signals, while the effect circuit 42 uses the supplied initial data in order to add an effect to the tone signals.

Then, the performance event data is read out one after another in accordance with the passage of time. In this case, if the read-out performance event data is on key-depression/release, the data is supplied to the tone generator 41. The tone generator 41 then forms tone signals corresponding to the supplied performance event data as in the case of performance data triggered by the keyboard 11. If the read-out performance event data is on tone color, the data is supplied to the tone generator 41 in order to be used for the control of the tone color of tone signals. If the read-out performance event data is on effect, the data is supplied to the effect circuit 42 in order to be used for the control of the effect of tone signals. The tone color parameters and effect parameters required by the performance event data for the use of the control of the tone color and effect are those stored in the ROM 33 or the external storage device 35.

Such automatic performance data can be supplied from the external electronic musical apparatus 52 or communications network 53 via the interface circuit 51. In this case as well as the above case, tone signals in accordance with the automatic performance data are generated, and the tone color of the tone signals to be generated and the effect to be added to the tone signals are controlled by the initial data or performance event data on tone color and effect which is included in the above-mentioned automatic performance data.

Above explained are the general operations of the present embodiment, while next explained in detail are the operations directly relating to the present invention. First explained is a case where tone control information for controlling the generating conditions of a tone signal is retrieved from outside to the electronic musical instrument, and the retrieved tone control information is utilized. In this case, the CPU 31 transfers the external tone color retrieval program stored in the hard disk which configures the external storage device 35 to the RAM 34, and the CPU 31 executes the program. The tone color program and the automatic performance replay program which will be described later may be stored previously in the hard disk, supplied from a flexible disk or compact disk, or supplied from the external electronic musical apparatus 52 or the communications network 53 via the interface circuit 51.

Figure 7:
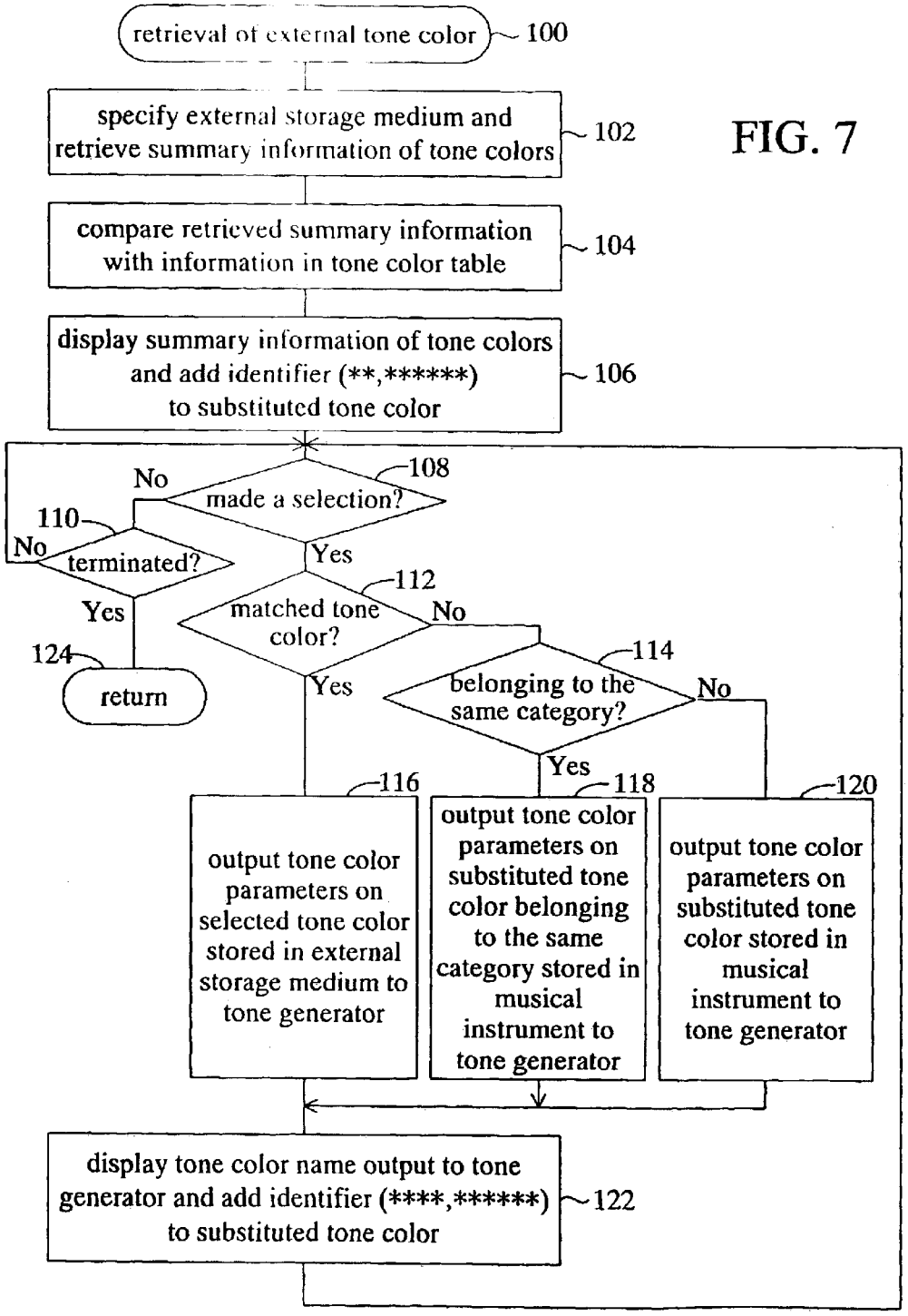
FIG. 7 is a flow chart showing an external tone color retrieval program executed by the electronic musical instrument shown in FIG. 1.

The CPU 31 starts executing the external tone color retrieval program at step 100 shown in FIG. 7 and proceeds to step 102 where an external storage medium storing tone color data is specified. In the step 102 the CPU 31 retrieves a summary information on tone colors from the specified external storage medium. In this case, on the display unit 13 there is displayed a list of external storage media from which tone color data may be retrieved, so that the user operates the panel operator group 12 in order to specify a medium from which tone color data is to be retrieved. To be specified as an external storage medium is a flexible disk or compact disk in the external storage device 35, the external electronic musical apparatus 52 or the communications network 53. In this case, the communications network 53 substantially represents an electronic musical apparatus which is disposed somewhere else and communicates via the communications network 53. In the explanation of the external tone color data described hereafter, these devices and apparatuses are collectively called an external storage medium.

After the above specification, the CPU 31 retrieves all the tone color number data stored in the external storage medium and displays on the display unit 13 all the tone color names corresponding to the tone color numbers. In the external storage medium there are stored at least plural pieces of tone color number data and tone color parameters provided for each tone color number in corresponding relation. An example format is given as the registration data shown in FIG. 6. In the external storage medium there may be stored tone color names so that those tone color names are directly utilized for the display of the tone color names.

After processing the step 102, at step 104 the CPU 31 compares the above-retrieved tone color number data with the tone color number data stored in the tone color table in the ROM 33. The CPU 31 then proceeds to step 106 and displays the tone color names represented by the retrieved tone color number data and substituted tone color names. In this case, if the tone color table has matching tone color number data, tone color names represented by the data are directly displayed. If the tone color table does not have matching tone color number data but has tone color number data belonging to the same category, a predetermined tone color name belonging to the category (e.g., a tone color name cited on the top of each category in FIG. 4) is selected as a substituted tone color name and displayed with an identifier (e.g., ) representing that the tone color name is a substitute added. Further, if the tone color table does not even have tone color number data belonging to the same category, a predetermined tone color name (e.g., a tone color name cited on the top of FIG. 4) is selected as a substituted tone color name and displayed with an identifier (e.g., ****) representing that the tone color name is a substitute added.

This display will now be explained, citing one example case. In this example case, the assumption is made that the present electronic musical instrument is prepared for only the tone colors listed in the column for the low-grade models in the tone color table in FIG. 4, as opposed to the external storage medium storing tone colors of grand piano, bright piano, electric piano, xylophone, marimba and my-tone (e.g., user-generated tone color). Regarding grand piano, electric piano and marimba, in this case, they are displayed as "grand piano", "electric piano" and "marimba", respectively without any change. The bright piano and xylophone are substituted by "grand piano" and "celesta", respectively and displayed as "grand piano" and "celesta", respectively. My-tone is substituted by "grand piano" and displayed as "grand piano******".

After processing the step 106, the CPU 31 determines at step 108 whether the user has made a selection and at step 110 whether the user has terminated the operation. If neither have been done, the CPU 31 gives "NO" at both step 108 and step 110 and keeps the loop process of step 108 and step 110 running. On the other hand, if the user selects one tone color displayed on the display unit 13 by operating the panel operator group 12, the CPU 31 gives "YES" at step 108 and proceeds to the determination processes of steps 112 and 114.

At step 112, the CPU 31 determines on the basis of the comparison of tone color numbers at the step 104 whether the user-selected tone color is a substituted tone color, that is, whether the user-selected tone color is displayed on the display unit 13 with an identifier for a substitute ( or **) added. At step 114, the CPU 31 determines on the basis of the comparison of tone color numbers at the step 104 whether the user-selected tone color is a substituted tone color belonging to the same category, that is, whether the user-selected tone color is displayed on the display unit 13 with an identifier for a substitute () added.

If the user-selected tone color is not a substitute, the CPU 31 gives "YES" at step 112 and proceeds to step 116. At step 116 the CPU 31 retrieves tone color number data and tone color parameters on the user-selected tone color which are stored in the external storage medium, and outputs at least the retrieved tone color parameters to the tone generator 41. The tone generator 41 stores the tone color parameters in order to prepare for the tone color control of the tone signals to be formed. In this case, if other tone color parameters are required in addition to the tone color parameters stored in the external storage medium, tone color parameters corresponding to the above-mentioned tone color number data are read out from the tone color data area in the ROM 33 and supplied to the tone generator 41 for the use of the above-mentioned tone color control.

If the user-selected tone color is a substituted tone color belonging to the same category, the CPU 31 gives "NO" and "YES" at step 112 and step 114, respectively, and proceeds to step 118. At step 118 the CPU 31 reads out the tone color parameters on the user-selected substitute tone color belonging to the same category from the ROM 33 and outputs the read-out parameters to the tone generator 41. The tone generator 41 stores these tone color parameters in order to prepare for the tone color control of tone signals to be formed.

If the user-selected tone color is a substituted tone color and does not belong to the same category, the CPU 31 gives "NO" to both steps 112 and 114 and proceeds to step 120. At step 120 the CPU 31 reads out tone color parameters on the user-selected substitute tone color (a substituted tone color which does not belong to the same category) from the ROM 33, and outputs the read-out parameters to the tone generator 41. The tone generator 41 stores these tone color parameters in order to prepare for the tone color control of tone signals to be formed.

Figures 8, 9:
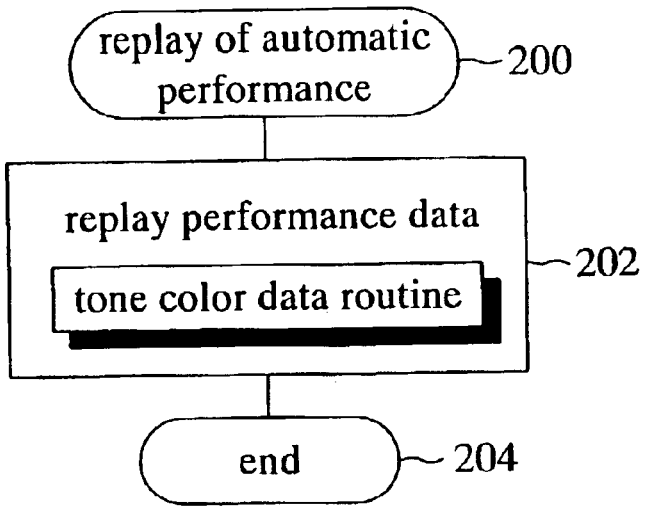
FIG. 8 is an example screen showing tone color names displayed on a display unit.
FIG. 9 is a flow chart showing an automatic performance replay program executed by the electronic musical instrument shown in FIG. 1.

After processing the steps from 116 to 120, at step 122 the CPU 31 displays on the display unit 13 the above-mentioned list of tone color names as well as the tone color name represented by the tone color parameters output to the tone generator 41. In this case as well, if the tone color is not a substitute, it is displayed without any identifier. As shown in FIG. 8, however, if it is a substitute belonging to the same category, it is displayed with an identifier, "**" added. If the tone color name is a substitute which does not belong to the same category, it is displayed with an identifier, "*****" added.

After processing the step 122, the CPU 31 returns to the step 108. On the other hand, if the user operates the panel operator group 12 in order to terminate the operation during the loop process of the steps 108 and 110, the CPU 31 gives "YES" at step 110 and terminates the execution of the external tone color retrieval program at step 124.

After the tone color parameters on the user-selected tone color are thus supplied to the tone generator 41, the user starts a performance using the keyboard 11. The tone signals caused by the performance with the keyboard 11 are formed by the tone generator 41 in the manner described above. In this case, used for the formation of tone signals by the tone generator 41 are the tone parameters derived from the processes from the step 116 to the step 120. Thus, tone signals to be generated are controlled so that they agree with the user-selected tone color.

In such external tone color retrieval control, if the user tries to retrieve tone color information (tone color parameters) stored in an external storage medium into the electronic musical instrument, tone colors which are not applicable to the tone generator 41 are substituted by an applicable tone color. In this case, if the tone generator 41 is prepared for the tone color information belonging to the same category as the tone color information stored in the external storage medium, the tone color information belonging to the same category is selected as a substituted tone color. If there is no tone color information applicable to the tone generator 41 and belonging to the same category, selected as a substituted tone color is a predetermined set of tone color information which is stored in the tone color table and applicable to the tone generator 41. As a result, the electronic musical instrument can avoid cases where some tone signals fail to be generated, increasing the possibilities of preventing tone signals with odd tone color from being generated.

When a tone color is substituted in the manner described above, on the display unit 13 there is displayed a tone color name with an identifier representing that the tone color is substituted. In addition, an identifier to be added varies between the case where a tone color belonging to the same category is selected as a substitute and the case where a tone color belonging to a different category is selected as a substitute. As a result, such identifiers facilitate the user to easily recognize that the tone color is a substitute, enhancing the convenience of the use of tone color information stored in the external storage medium.

In the above example there is explained only a case where tone color information stored in an external storage medium is used in the electronic musical instrument. However, this usage of information stored in an external storage medium may be applied to the tone control information for controlling generating conditions of musical tones such as effect data for controlling an effect to be added to a tone signal and style data (type of automatic accompaniment) used as the control information for controlling automatic accompaniment. That is, in the cases of effect and style as well, effect data and style data stored in the external storage medium is retrieved and the corresponding effect name and style name are displayed on the display unit 13. In these cases, effect data and style data which is not applicable to the present electronic musical instrument is substituted by the data applicable to the present electronic musical instrument, and the substituted names are displayed. If the effect data and style data belonging to the same category as the effect data and style data stored in the external storage medium is applicable to the present electronic musical instrument, the effect data and style data which is predetermined and belongs to the same category is selected as substituted effect data and style data.

When effect data and style data is substituted as described above, on the display unit 13 there are displayed an effect name and style name with an identifier representing that the displayed effect name and style name are substitutes. In addition, an identifier to be added varies between the case where the effect and style names belonging to the same category are selected as substitutes and the case where those belonging to a different category are selected as substitutes. As a result, such identifiers facilitate the user to easily recognize that the effect data and style data is a substitute, enhancing the convenience of the use of effect data and style data stored in the external storage medium.

Next described will be the case where automatic performance data stored outside is replayed. By operating the panel operator group 12, in this case, the user selects a set of automatic performance data from among plural sets of automatic performance data stored in a storage medium such as flexible disk or compact disk which configures the external storage device 35. Also, in the case of automatic performance data downloaded via the interface circuit 51 into the hard disk of the external storage device 35 or the RAM 34 as well, the user selects in a like manner. After the selection of automatic performance data, the CPU 31 executes the automatic performance replay program shown in FIG. 9. The execution of the automatic performance replay program is initiated at step 200. In the step 202 performance data is replayed. The replay process of automatic performance data is done as described above. After finishing the replay process of step 202, the CPU 31 terminates the execution of the automatic performance replay program at step 204.

Figure 3:
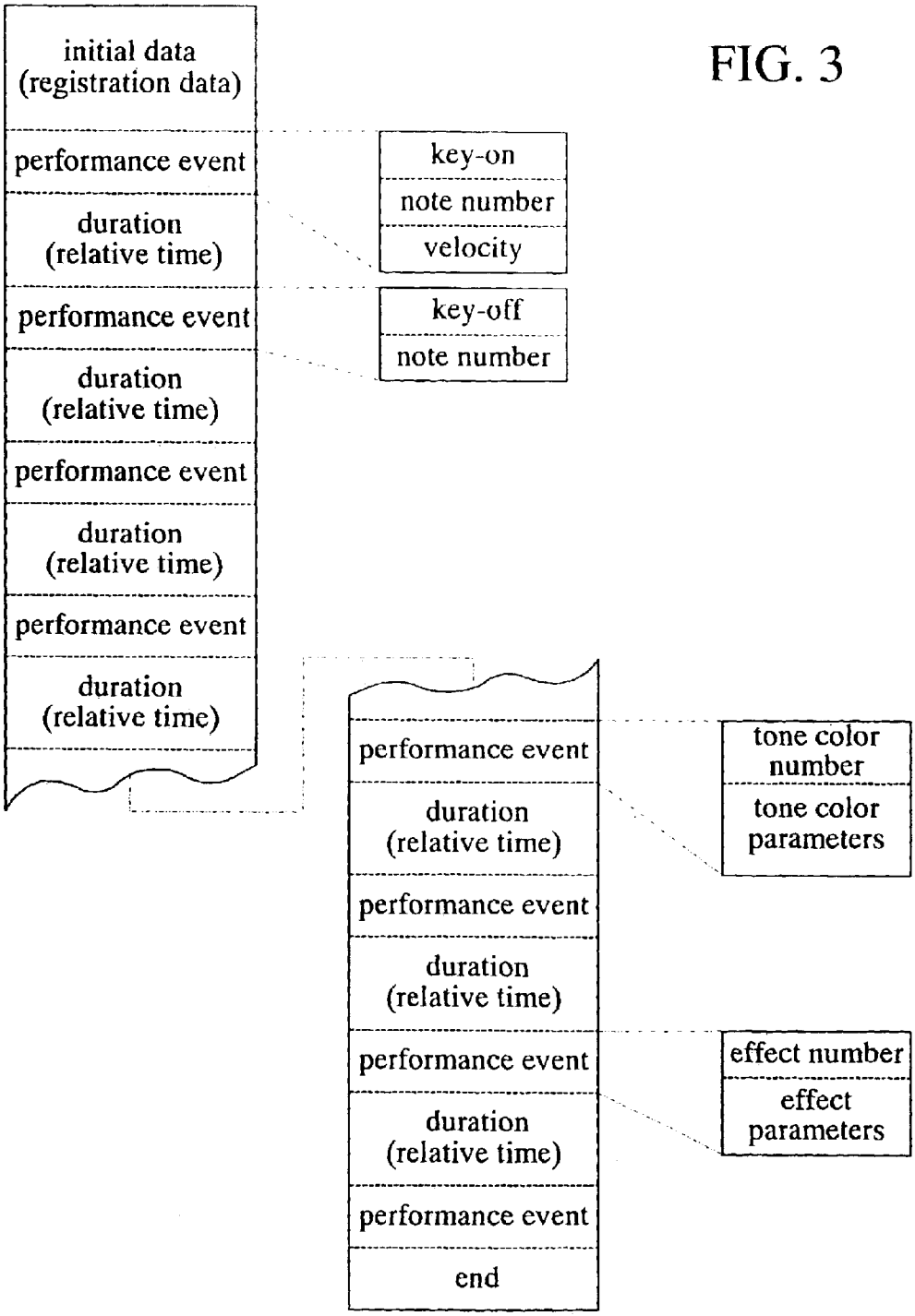
FIG. 3 is a data format diagram showing example automatic performance data used by the electronic musical instrument shown in FIG. 1.
Figure 10:
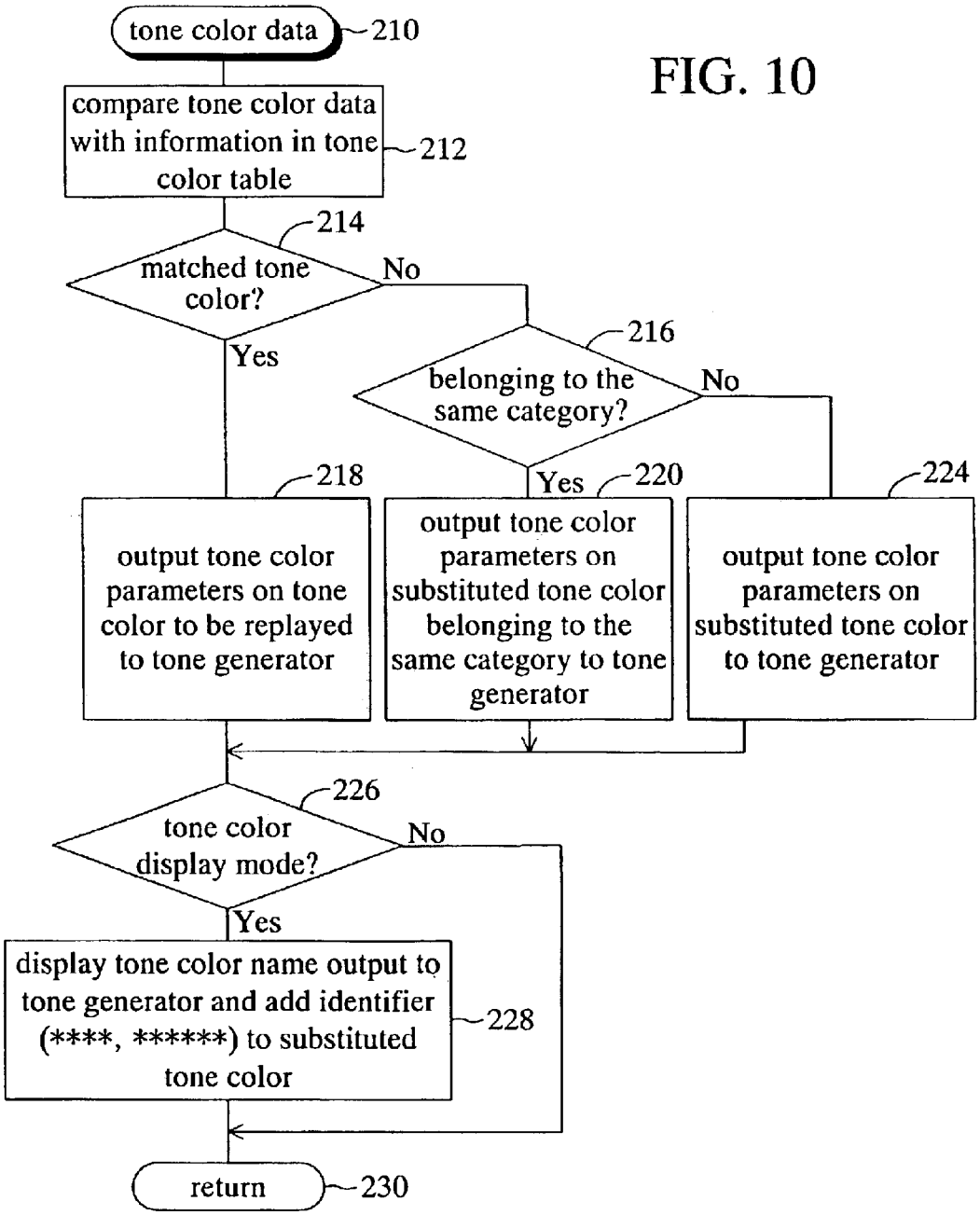
FIG. 10 is a flow chart showing the details of a tone color data routine included in the replay program shown in FIG. 9.

On the other hand, when the CPU 31 reads out tone color data (tone color number data and tone color parameters) in the initial data and performance event data in the automatic performance data as shown in FIG. 3 in the course of executing the replay process of automatic performance data (see FIG. 3) at step 202, the CPU 31 executes a tone color data routine shown in FIG. 10. The CPU 31 initiates the tone color data routine at step 210 and proceeds to step 212 at which the CPU 31 compares the above-read tone color number data with the tone color number data stored in the tone color table in the ROM 33.

After the comparison of tone color numbers at the step 212, at step 214 the CPU 31 determines, on the basis of the comparison, whether the tone color table has tone color number data which agrees with the read-out tone color number data. If the tone color table does, the CPU 31 gives "YES" at step 214 and proceeds to step 218. At the step 218 the CPU retrieves the read-out tone color number data and tone color parameters and outputs at least the retrieved tone color parameters to the tone generator 41. The tone generator 41 stores the tone color parameters in order to utilize them for controlling a tone color of tone signals to be formed later. In this case, when other tone color parameters are required in addition to the read-out tone color parameters, tone color parameters corresponding to the aforementioned tone color number data are read out from the tone color area in the ROM 33 and supplied to the tone generator 41 for the use of the tone color control. Particularly, when the read-out tone color data does not include tone color parameters, the tone color parameters read out from the tone color data area in the ROM 33 and supplied to the tone generator 41 are effectively used.

If the tone color table does not have tone color number data which agrees with the read-out tone color number data, the CPU 31 gives "NO" at step 214 and proceeds to step 216 in order to execute a determination process. In this determination process, the CPU 31 determines whether the tone color table has a tone color category which agrees with the category to which the read-out tone color number data belongs. If the tone color table does, the CPU 31 gives "YES" at step 216 and proceeds to step 220. At the step 220, as a substituted tone color, the CPU 31 selects, from among tone colors stored in the tone color table, a predetermined tone color in the category to which the read-out tone color number data belongs. The CPU 31 then reads out the tone color parameters on the substituted tone color from the tone color data area in the ROM 33, and outputs the read-out parameters to the tone generator 41. The tone generator 41 stores the tone color parameters in order to utilize for controlling a tone color of tone signals to be formed later.

If the tone color table does not have the category to which the read-out tone color number data belongs, the CPU 31 gives "NO" at step 216 and proceeds to step 224. At the step 224 the CPU 31 selects a predetermined tone color from the tone color table as a substitute, reads out tone color parameters for the substituted tone color from the tone color data area in the ROM 33, and outputs the read-out tone color parameters to the tone generator 41. The tone generator 41 stores these tone color parameters in order to use for the tone color control of tone signals to be formed later.

After processing the steps from 218 to 224, the CPU 31 determines at step 226 whether the electronic musical instrument is in the tone color display mode. If it is, the CPU 31 gives "YES" at step 226 and proceeds to step 228. After processing the step 228, the CPU 31 terminates the execution of the tone color data routine at step 230. On the other hand, if the electronic musical instrument is not in the tone color display mode, the CPU 31 gives "NO" at step 226 and terminates the execution of the tone color data routine.

At the step 228 the CPU 31 displays on the display unit 13 the tone color name represented by the tone color parameters output to the tone generator 41 (see the lower part of FIG. 8). In this case as well, if the tone color name is not a substitute, the tone color name is displayed without any change. If the tone color name is a substituted tone color name belonging to the same category, however, the tone color name is displayed with an identifier, "**" added. If the tone color name is a substituted tone color belonging to a different category, the tone color name is displayed with an identifier, "****" added.

As explained above, if automatic performance data includes tone color data, the tone color of tone signals to be generated on the basis of key performance data is controlled by the tone color data. In this case, if the tone generator 41 is not prepared for the tone color represented by the tone color data in the automatic performance data, the tone color is substituted by a tone color for which the tone generator 41 is prepared. Besides, if the tone generator 41 is prepared for tone color information belonging to the same category, the tone color information is selected as a substituted tone color. As a result, the electronic musical instrument can avoid cases where some tone signals fail to be generated, increasing the possibilities of preventing tone signals with odd tone color from being generated.

When a tone color is substituted in the manner described above, on the display unit 13 there is displayed a tone color name with an identifier representing that the tone color is substituted. In addition, an identifier to be added varies between the case where a tone color belonging to the same category is selected as a substitute and the case where a tone color belonging to a different category is selected as a substitute. As a result, such identifiers facilitate the user to easily recognize that the tone color is a substitute, enhancing the convenience of the use of tone color information stored in the external storage medium.

Given in the above example is an explanation only for the tone color data in automatic performance data. However, the above example may be applied to the tone control information for controlling generating conditions of musical tones such as control information for controlling an effect to be added to a tone signal or style data (type of automatic accompaniment) used as the control information for controlling automatic accompaniment. That is, in the cases of effect and style as well, the read-out effect data and style data are also substituted in the same manner of the tone color, and the substituted effect and style names are displayed on the display unit 13. However, the display of these names is limited to the cases where the display of an effect name and style name is selected. In these cases as well, if the effect data and style data belonging to the same category as the read-out effect data and style data is applicable to the present electronic musical instrument, the effect data and style data belonging to the same category is selected as substituted effect data and style data.

When effect data and style data is substituted as described above, on the display unit 13 there are displayed an effect name and style name with an identifier representing that the displayed effect name and style name are substitutes. In addition, an identifier to be added varies between the case where the effect and style names belonging to the same category are selected as substitutes and the case where those belonging to a different category are selected as substitutes. As a result, such identifiers facilitate the user to easily recognize that the effect data and the style data is a substitute, enhancing the convenience of the use of effect data and style data stored in the external storage medium.

In the above embodiment, in the tone color data storage area and effect data storage area in the ROM 33 there are stored basic tone color parameters and effect parameters in corresponding relation to the tone color table and effect table. Instead of the above, however, the tone generator 41 may serve to store the tone color parameters in corresponding relation to the tone color numbers so that the tone color parameters are utilized for the tone color control at the time of the formation of tone signals. In addition, the effect circuit 42 may serve to store the effect parameters in corresponding relation to the effect numbers so that the effect parameters are utilized for the effect control at the time of addition of an effect to tone signals.

In the above embodiment, furthermore, when a tone color name, effect name or style name is displayed on the display unit 13, symbols such as "", "" or "****" are added to a substitute as an identifier. However, the symbols may be something different. Alternatively, the identification of a substitute may be realized by giving a different font to a substitute or underlining a substitute. In these cases as well, the symbols, font or underline used for the identification may vary between a substitute belonging to the same category and a substitute belonging to a different category.

In the above embodiment, furthermore, description has been given on examples where the present invention is applied to the electronic musical instrument having the keyboard 11 as a performance operator, however, the present invention may be applied to various musical instruments having touch plates, push buttons, strings or the like as a performance operator. Besides electronic musical instruments, the present invention is also applicable to various devices capable of generating tone signals such as a sequencer device or a personal computer device.

Furthermore, in carrying out the present invention, it will be understood that the present invention is not limited to the above-described embodiment and its variations, but various modifications may be made without departing from the spirit and scope of the invention.

What is claimed is:

1. An electronic musical apparatus having a musical tone signal generator for generating a musical tone signal whose generating conditions are controlled in accordance with input musical tone control information, an internal storage device for storing plural types of musical tone control information for which said musical tone signal generator is prepared, and a display unit for displaying a name of musical tone control information stored outside for selective use by a user, said electronic musical apparatus comprising:

a display controller for automatically selecting, in accordance with predetermined conditions, one type of musical tone control information as substituted musical tone control information from among plural types of musical tone control information stored in said internal storage device when musical tone control information which is stored outside and for which said musical tone signal generator is not prepared is intended to be input on the occasion of input of musical tone control information stored outside, and displaying on said display unit a name of said substitute musical tone control information in a manner which allows a user to recognize that the displayed musical tone control information is substituted;

an information selector for selecting musical tone control information corresponding to said name displayed on said display unit; and an information provider for retrieving musical tone control information selected by said information selector from outside and providing said retrieved musical tone control information to said musical tone signal generator when the selected musical tone control information is not said substitute musical tone control information, and for providing said substitute musical tone control information stored in said internal storage device to said musical tone signal generator when musical tone control information selected by said information selector is said substitute musical tone control information.

2. An electronic musical apparatus according to claim 1, wherein said internal storage device stores plural types of musical tone control information under plural categories; and said display controller includes a first selector for automatically selecting as substituted musical tone control information, from among plural types of musical tone control information stored in said internal storage device, musical tone control information belonging to an identical category when among said musical tone control information stored outside, musical tone control information for which said musical tone signal generator is not prepared is intended to be input.

3. An electronic musical apparatus according to claim 2, wherein said display controller further includes a second selector for automatically selecting as substituted musical tone control information, from among plural types of musical tone control information stored in said internal storage device, a predetermined type of musical tone control information when among said musical tone control information stored outside, musical tone control information for which said musical tone signal generator is not prepared is intended to be input and said internal storage device does not store any musical tone control information belonging to an identical category with the intended musical tone control information.

4. An electronic musical apparatus according to claim 3, wherein a name of substituted musical tone control information selected by said first selector and a name of substituted musical tone control information selected by said second selector are displayed on a display unit with a varying identification manner provided respectively.

5. An electronic musical apparatus having a musical tone signal generator for generating a musical tone signal whose generating conditions are controlled in accordance with input musical tone control information, an internal storage device for storing plural types of musical tone control information for which said musical tone signal generator is prepared, and a display unit, said electronic musical apparatus comprising:

an information retriever for retrieving musical tone control information from outside; and a substitute controller for automatically selecting, in accordance with predetermined conditions, one type of musical tone control information as substituted musical tone control information from among plural types of musical tone control information stored in said internal storage device when said musical tone control information retrieved from outside is not applicable to said musical tone signal generator, providing the substituted information to said musical tone signal generator, and displaying on said display unit a name of said substitute musical tone control information in a manner which allows a user to recognize that the displayed musical tone control information is substituted.

6. An electronic musical apparatus according to claim 5, wherein said internal storage device stores plural types of musical tone control information under plural categories; and said substitute controller includes a first selector for automatically selecting, as substituted musical tone control information, musical tone control information belonging to an identical category with said musical tone control information retrieved from outside from among plural types of musical tone control information stored in said internal storage device and providing the substituted information to said musical tone signal generator, and a first display controller for displaying, on said display unit, a name of the substituted musical tone control information selected by said first selector in a first identification manner which allows a user to identify said name as substitute.

7. An electronic musical apparatus according to claim 6, wherein said substitute controller further includes:

a second selector for automatically selecting, as substituted musical tone control information, a predetermined type of musical tone control information from among plural types of musical tone control information stored in said internal storage device when said musical tone control information retrieved from outside is not applicable to said musical tone signal generator and does not belong to any categories of plural types of musical tone control information stored in said internal storage device, and providing the substituted information to said musical tone signal generator; and a second display controller for displaying, on said display unit, a name of the substituted musical tone control information selected by said second selector in a second identification manner which allows a user to identify the displayed name as substitute and which is different from said first identification manner.

8. A method applied to an electronic musical apparatus having a musical tone signal generator for generating a musical tone signal whose generating conditions are controlled in accordance with input musical tone control information, an internal storage device for storing plural types of musical tone control information for which said musical tone signal generator is prepared, and a display unit for displaying a name of musical tone control information stored outside for selective use by a user, said method containing:

a display controlling step for automatically selecting, in accordance with predetermined conditions, one type of musical tone control information as substituted musical tone control information from among plural types of musical tone control information stored in said internal storage device when musical tone control information which is stored outside and not applicable to said musical tone signal generator is intended to be input on the occasion of input of musical tone control information stored outside, and displaying on said display unit a name of said substitute musical tone control information in a manner which allows a user to recognize that the displayed musical tone control information is substituted;

an information selecting step for selecting musical tone control information corresponding to the name displayed on said display unit by user's selecting operations; and an information providing step for retrieving the selected musical tone control information from outside and providing said retrieved musical tone control information to said musical tone signal generator when the selected musical tone control information is not said substitute musical tone control information, and providing said substitute musical tone control information stored in said internal storage device to said musical tone signal generator when the selected musical tone control information is said substitute musical tone control information.

9. A method according to claim 8, wherein, said internal storage device stores plural types of musical tone control information under plural categories; and said display controlling step includes a first selecting step for automatically selecting as substituted musical tone control information, from among plural types of musical tone control information stored in said internal storage device, musical tone control information belonging to an identical category when among said musical tone control information stored outside, musical tone control information for which said musical tone signal generator is not prepared is intended to be input.

10. A method according to claim 9, wherein said display controlling step further includes a second selecting step for automatically selecting as substituted musical tone control information, from among plural types of musical tone control information stored in said internal storage device, a predetermined type of musical tone control information when among said musical tone control information stored outside, musical tone control information for which said musical tone signal generator is not prepared is intended to be input and said internal storage device does not store any musical tone control information belonging to an identical category with the intended musical tone control information.

11. A method according to claim 10, wherein a name of substituted musical tone control information selected by said first selecting step and a name of substituted musical tone control information selected by said second selecting step are displayed on a display unit with a varying identification manner provided respectively.

12. A method applied to an electronic musical apparatus having a musical tone signal generator for generating a musical tone signal whose generating conditions are controlled in accordance with input musical tone control information, an internal storage device for storing plural types of musical tone control information for which said musical tone signal generator is prepared, and a display unit, said method containing:

an information retrieving step for retrieving musical tone control information from outside; and a substitute controlling step for automatically selecting, in accordance with predetermined conditions, one type of musical tone control information as substituted musical tone control information from among plural types of musical tone control information stored in said internal storage device, providing the substituted information to said musical tone signal generator, and displaying on said display unit a name of said substitute musical tone control information in a manner which allows a user to recognize that the displayed musical tone control information is substituted when said musical tone control information retrieved from outside is not applicable to said musical tone signal generator.

13. A method according to claim 12, wherein said internal storage device stores plural types of musical tone control information under plural categories; and said substitute controlling step includes a first selecting step for automatically selecting, as substituted musical tone control information, musical tone control information belonging to an identical category with said musical tone control information retrieved from outside from among plural types of musical tone control information stored in said internal storage device and providing the substituted information to said musical tone signal generator, and a first display controlling step for displaying, on said display unit, a name of the substituted musical tone control information selected by said first selecting step in a first identification manner which allows a user to identify said name as substitute.

14. A method according to claim 13, wherein said substitute controlling step further includes:

a second selecting step for automatically selecting, as substituted musical tone control information, a predetermined type of musical tone control information from among plural types of musical tone control information stored in said internal storage device when said musical tone control information retrieved from outside is not applicable to said musical tone signal generator and does not belong to any categories of plural types of musical tone control information stored in said internal storage device, and providing the substituted information to said musical tone signal generator; and a second display controlling step for displaying, on said display unit, a name of the substituted musical tone control information selected by said second selecting step in a second identification manner which allows a user to identify the displayed name as substitute and which is different from said first identification manner.

15. A computer readable program applied to an electronic musical apparatus having a musical tone signal generator for generating a musical tone signal whose generating conditions are controlled in accordance with input musical tone control information, an internal storage device for storing plural types of musical tone control information for which said musical tone signal generator is prepared, and a display unit for displaying a name of musical tone control information stored outside for selective use by a user, said computer readable program containing:

a display controlling step for automatically selecting, in accordance with predetermined conditions, one type of musical tone control information as substituted musical tone control information from among plural types of musical tone control information stored in said internal storage device when musical tone control information which is stored outside and not applicable to said musical tone signal generator is intended to be input on the occasion of input of musical tone control information stored outside, and displaying on said display unit a name of said substitute musical tone control information in a manner which allows a user to recognize that the displayed musical tone control information is substituted;

an information selecting step for selecting musical tone control information corresponding to the name displayed on said display unit by user's selecting operations; and an information providing step for retrieving the selected musical tone control information from outside and providing said retrieved musical tone control information to said musical tone signal generator when the selected musical tone control information is not said substitute musical tone control information, and providing said substitute musical tone control information stored in said internal storage device to said musical tone signal generator when the selected musical tone control information is said substitute musical tone control information.

16. A computer readable program according to claim 15, wherein, said internal storage device stores plural types of musical tone control information under plural categories; and said display controlling step includes a first selecting step for automatically selecting as substituted musical tone control information, from among plural types of musical tone control information stored in said internal storage device, musical tone control information belonging to an identical category when among said musical tone control information stored outside, musical tone control information for which said musical tone signal generator is not prepared is intended to be input.

17. A computer readable program according to claim 16, wherein said display controlling step further includes a second selecting step for automatically selecting as substituted musical tone control information, from among plural types of musical tone control information stored in said internal storage device, a predetermined type of musical tone control information when among said musical tone control information stored outside, musical tone control information for which said musical tone signal generator is not prepared is intended to be input and said internal storage device does not store any musical tone control information belonging to an identical category with the intended musical tone control information.

18. A computer readable program according to claim 17, wherein a name of substituted musical tone control information selected by said first selecting step and a name of substituted musical tone control information selected by said second selecting step are displayed on a display unit with a varying identification manner provided respectively.

19. A computer readable program applied to an electronic musical apparatus having a musical tone signal generator for generating a musical tone signal whose generating conditions are controlled in accordance with input musical tone control information, an internal storage device for storing plural types of musical tone control information for which said musical tone signal generator is prepared, and a display unit, said computer readable program containing:

an information retrieving step for retrieving musical tone control information from outside; and a substitute controlling step for automatically selecting, in accordance with predetermined conditions, one type of musical tone control information as substituted musical tone control information from among plural types of musical tone control information stored in said internal storage device, providing the substituted information to said musical tone signal generator, and displaying on said display unit a name of said substitute musical tone control information in a manner which allows a user to recognize that the displayed musical tone control information is substituted when said musical tone control information retrieved from outside is not applicable to said musical tone signal generator.

20. A computer readable program according to claim 19, wherein said internal storage device stores plural types of musical tone control information under plural categories; and said substitute controlling step includes a first selecting step for automatically selecting, as substituted musical tone control information, musical tone control information belonging to an identical category with said musical tone control information retrieved from outside from among plural types of musical tone control information stored in said internal storage device and providing the substituted information to said musical tone signal generator, and a first display controlling step for displaying, on said display unit, a name of the substituted musical tone control information selected by said first selecting step in a first identification manner which allows a user to identify said name as substitute.

21. A computer readable program according to claim 20, wherein said substitute controlling step further includes:

a second selecting step for automatically selecting, as substituted musical tone control information, a predetermined type of musical tone control information from among plural types of musical tone control information stored in said internal storage device when said musical tone control information retrieved from outside is not applicable to said musical tone signal generator and does not belong to any categories of plural types of musical tone control information stored in said internal storage device, and providing the substituted information to said musical tone signal generator; and a second display controlling step for displaying, on said display unit, a name of the substituted musical tone control information selected by said second selecting step in a second identification manner which allows a user to identify the displayed name as substitute and which is different from said first identification manner.

* * * * *